US009216315B1

(12) United States Patent
Chang et al.

(10) Patent No.: US 9,216,315 B1
(45) Date of Patent: Dec. 22, 2015

(54) MULTIFUNCTIONAL EXERCISING DEVICE

(71) Applicants: Li-Ling Chang, Taichung (TW); Hsiu-Ling Lin, Taichung (TW)

(72) Inventors: Li-Ling Chang, Taichung (TW); Hsiu-Ling Lin, Taichung (TW)

( * ) Notice: Subject to any disclaimer, the term of this patent is extended or adjusted under 35 U.S.C. 154(b) by 22 days.

(21) Appl. No.: 14/296,508

(22) Filed: Jun. 5, 2014

(51) Int. Cl.
*A63B 21/075* (2006.01)
*A63B 23/12* (2006.01)

(52) U.S. Cl.
CPC ..... *A63B 21/075* (2013.01); *A63B 23/1236* (2013.01)

(58) Field of Classification Search
CPC ..... A63B 21/0004; A63B 21/00061; A63B 21/00065; A63B 21/00094; A63B 21/00101; A63B 21/00109; A63B 21/00116; A63B 21/00123; A63B 21/00127; A63B 21/0013; A63B 21/02; A63B 21/023; A63B 21/025; A63B 21/04; A63B 21/0407; A63B 21/0414; A63B 21/0421; A63B 21/0428; A63B 21/0435; A63B 21/0442; A63B 21/045; A63B 21/0455; A63B 21/06; A63B 21/062; A63B 21/072; A63B 21/0724; A63B 21/0726; A63B 21/0728; A63B 21/075; A63B 21/08; A63B 21/1446; A63B 21/1465; A63B 21/1469; A63B 21/1476; A63B 21/1484; A63B 21/1492; A63B 21/1496; A63B 2021/0623; A63B 2021/0626; A63B 2021/0722; A63B 23/035; A63B 23/03508; A63B 23/03516; A63B 23/03525; A63B 23/03533; A63B 23/03541; A63B 23/12; A63B 23/1209; A63B 23/1227; A63B 23/1236; A63B 23/1245; A63B 23/1281; A63B 39/08; A63B 43/02; A63B 2208/02; A63B 2208/0204; A63B 2208/0209; A63B 2208/0214; A63B 2208/0223; A63B 2208/0228; A63B 2208/0233; A63B 2208/0238; A63B 2208/0242; A63B 2208/0252; A63B 2208/0295; A63B 2244/09
See application file for complete search history.

(56) References Cited

U.S. PATENT DOCUMENTS

| | | | | | |
|---|---|---|---|---|---|
| 777,478 | A * | 12/1904 | Minor | 482/93 |
| 4,431,185 | A * | 2/1984 | Cisneros | 482/93 |
| 4,896,880 | A * | 1/1990 | Caruthers | 482/108 |
| 5,342,268 | A * | 8/1994 | Caruthers | 482/108 |
| 5,346,450 | A * | 9/1994 | Caruthers | 482/108 |
| 5,735,776 | A * | 4/1998 | Swezey et al. | 482/91 |
| 7,491,157 | B1 * | 2/2009 | Lin | 482/108 |
| 7,762,933 | B1 * | 7/2010 | Yu | 482/107 |
| 7,942,792 | B1 * | 5/2011 | Wyman et al. | 482/93 |
| 7,981,016 | B1 * | 7/2011 | Howard | 482/141 |
| 8,021,282 | B2 * | 9/2011 | Polevoy et al. | 482/108 |
| 8,128,537 | B2 * | 3/2012 | Signorile et al. | 482/94 |
| 8,454,483 | B1 * | 6/2013 | Bradley et al. | 482/92 |
| 8,568,280 | B2 * | 10/2013 | Mendoza | 482/108 |
| 8,944,962 | B2 * | 2/2015 | Montanari | 482/23 |
| 8,944,971 | B2 * | 2/2015 | Shorter | 482/108 |
| 9,022,906 | B1 * | 5/2015 | Nelson | 482/108 |
| 2004/0219988 | A1 * | 11/2004 | Park et al. | 473/256 |
| 2005/0250627 | A1 * | 11/2005 | Park | 482/93 |
| 2006/0035767 | A1 * | 2/2006 | Ekhaus | 482/108 |
| 2007/0135274 | A1 * | 6/2007 | Blateri | 482/109 |

(Continued)

*Primary Examiner* — Oren Ginsberg
*Assistant Examiner* — Gary D Urbiel Goldner
(74) *Attorney, Agent, or Firm* — Alan D. Kamrath; Kamrath IP Lawfirm, P.A.

(57) ABSTRACT

An exercising device includes two hollow shells (10) combined with each other, one grip (20) mounted on each of the hollow shells, and one weight module (30) mounted in each of the hollow shells. Thus, the hollow shells can be combined together and separated from each other to function as a weighting ball, a push-up aid device and dumbbells, so that the exercising device has multiple functions to perform diverse exercising and bodybuilding motions.

9 Claims, 15 Drawing Sheets

(56) References Cited

U.S. PATENT DOCUMENTS

| | | | | |
|---|---|---|---|---|
| 2007/0225133 | A1* | 9/2007 | Castro | 482/140 |
| 2008/0305935 | A1* | 12/2008 | Sanghavi | 482/91 |
| 2009/0298656 | A1* | 12/2009 | Dannenberg | 482/141 |
| 2010/0331151 | A1* | 12/2010 | Signorile et al. | 482/93 |
| 2011/0230313 | A1* | 9/2011 | Gamboa | 482/51 |
| 2011/0251029 | A1* | 10/2011 | Verheem | 482/110 |
| 2012/0053024 | A1* | 3/2012 | Mendoza | 482/106 |
| 2012/0157270 | A1* | 6/2012 | Johnson | 482/93 |
| 2012/0309599 | A1* | 12/2012 | Miller, Jr. | 482/139 |
| 2013/0190150 | A1* | 7/2013 | Delisle | 482/141 |
| 2013/0310234 | A1* | 11/2013 | Miller, Jr. | 482/139 |
| 2014/0024507 | A1* | 1/2014 | Hagos | 482/108 |
| 2014/0141944 | A1* | 5/2014 | Johnson et al. | 482/93 |
| 2014/0194258 | A1* | 7/2014 | Shorter | 482/93 |

* cited by examiner

MULTIFUNCTIONAL EXERCISING DEVICE

BACKGROUND OF THE INVENTION

1. Field of the Invention

The present invention relates to an exercising device and, more particularly, to a multifunctional exercising device.

2. Description of the Related Art

A conventional weighting ball exercising device comprises a ball having a through hole, a weight mounted in the through hole of the ball, and two covers mounted on the surface of the ball to cover the weight. The through hole of the ball extends through the ball. The two covers seal two opposite ends of the through hole of the ball. The weight has a density greater than that of the ball. Thus, the user's two hands can hold the ball to move the ball upward and downward so as to exercise the user's arms. However, the ball only has a single function, thereby limiting the versatility of the conventional weighting ball exercising device. In addition, the user has to purchase other exercising devices, such as a push-up aid, dumbbells and the like, to achieve other exercising or bodybuilding functions, thereby increasing the cost, and thereby needing a larger space of storage. Further, the weight of the conventional weighting ball exercising device is fixed and cannot be adjusted according to the user's practical requirement, thereby limiting the exercising and bodybuilding effects.

BRIEF SUMMARY OF THE INVENTION

In accordance with the present invention, there is provided an exercising device comprising two hollow shells combined with each other, one grip mounted on each of the hollow shells, and one weight module mounted in each of the hollow shells. Each of the weight modules includes a positioning member secured in the respective hollow shell, a covering plate locked onto the positioning member, and a plurality of weighting members mounted in the positioning member and located between the positioning member and the covering plate.

According to the primary advantage of the present invention, the hollow shells can be combined together and separated from each other to function as a weighting ball, a push-up aid device and dumbbells, so that the exercising device has multiple functions to perform diverse exercising and bodybuilding motions to enhance the versatility of the exercising device.

According to another advantage of the present invention, the number of the weighting members can be changed to adjust the weight of each of the weight modules according to the user's requirement.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
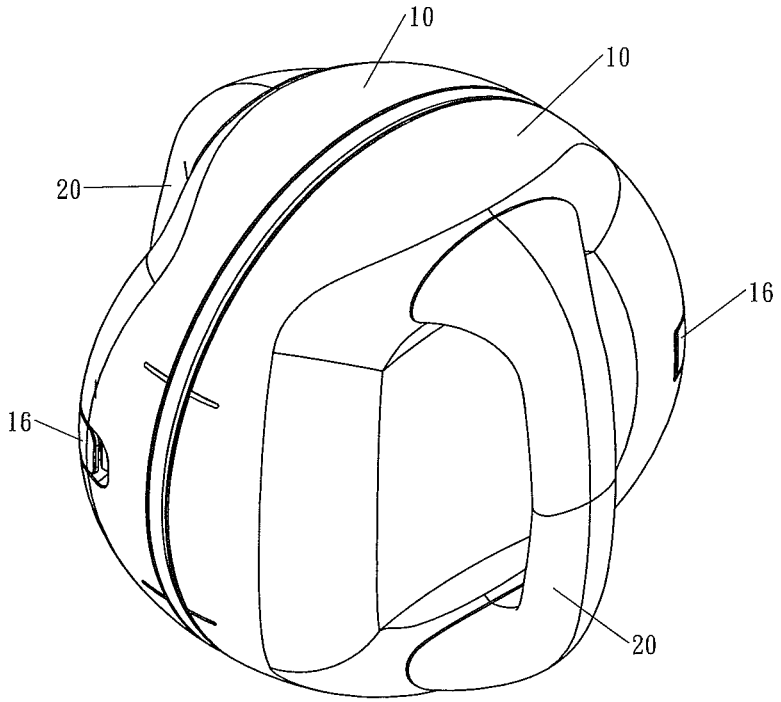
FIG. 1 is a perspective view of an exercising device in accordance with the preferred embodiment of the present invention.
Figure 2:
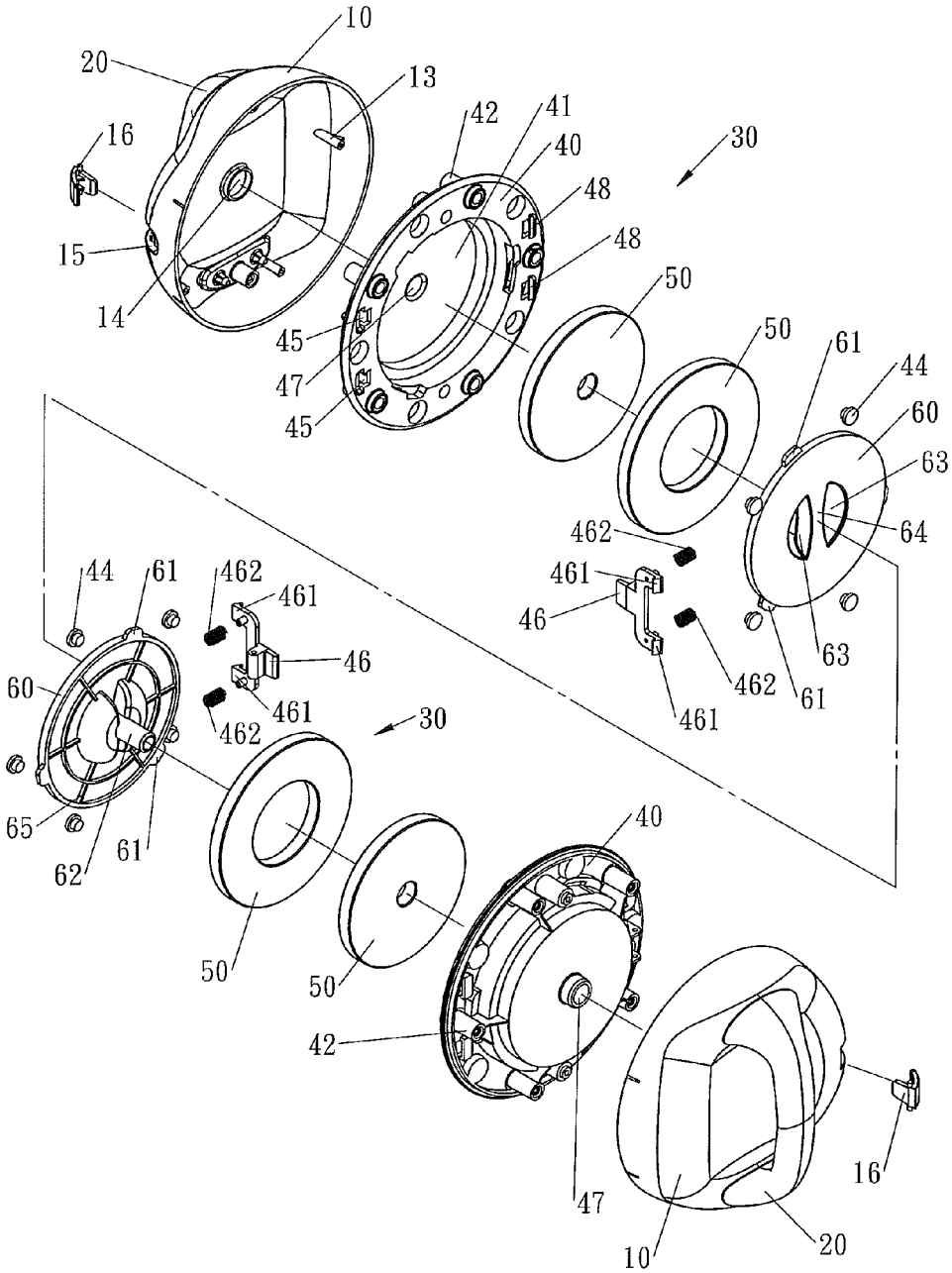
FIG. 2 is an exploded perspective view of the exercising device as shown in FIG. 1.
Figure 3:
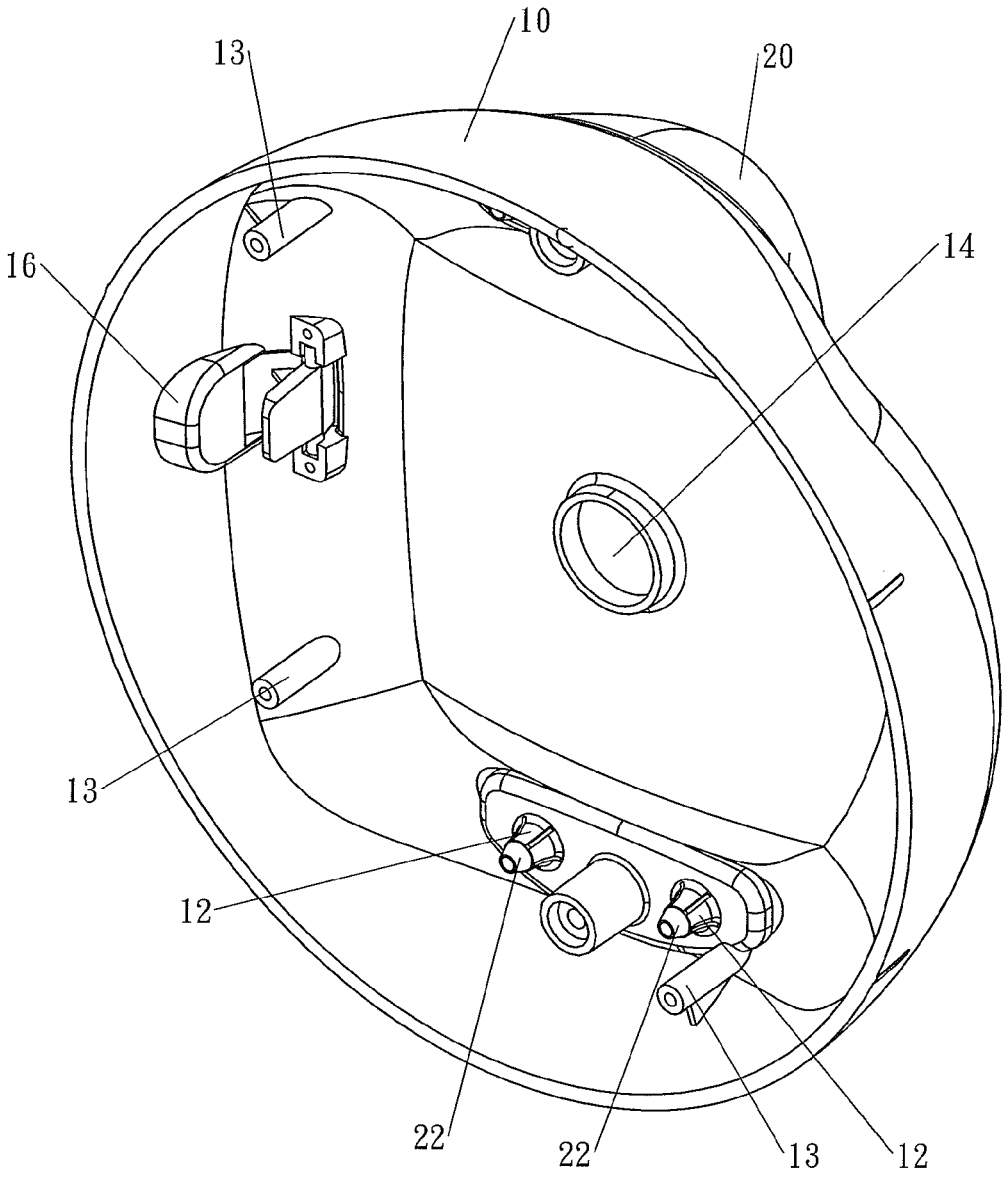
FIG. 3 is a partially perspective view of the exercising device as shown in FIG. 1.
Figure 4:
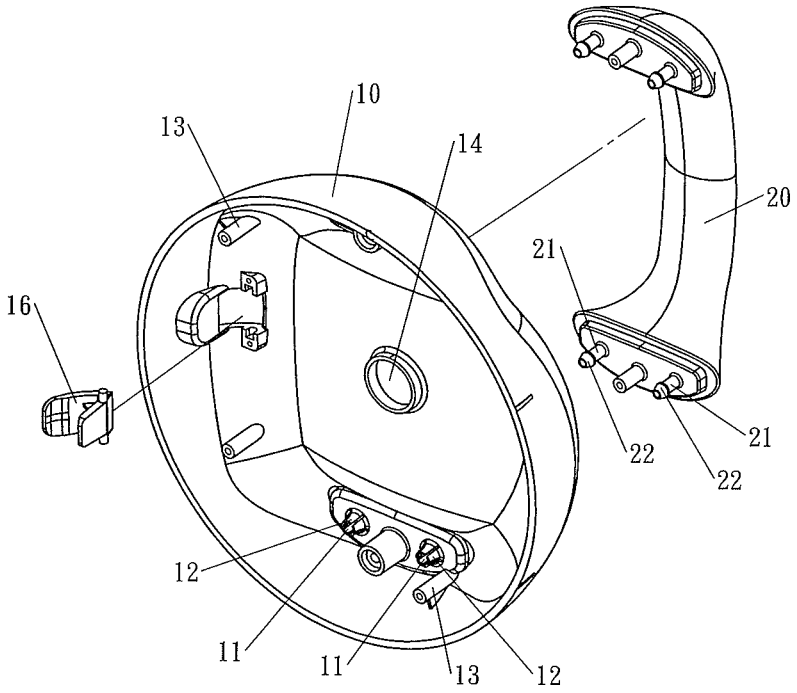
FIG. 4 is a partially exploded perspective view of the exercising device as shown in FIG. 3.
Figure 5:
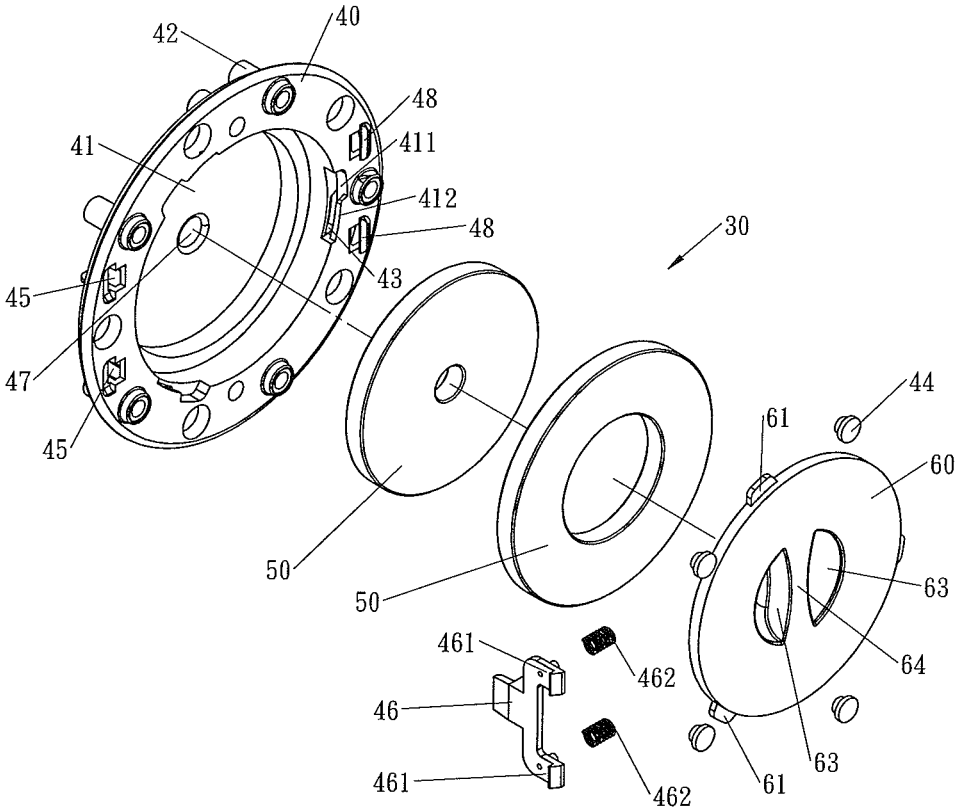
FIG. 5 is an exploded perspective view of a weight module of the exercising device as shown in FIG. 2.
Figure 6:
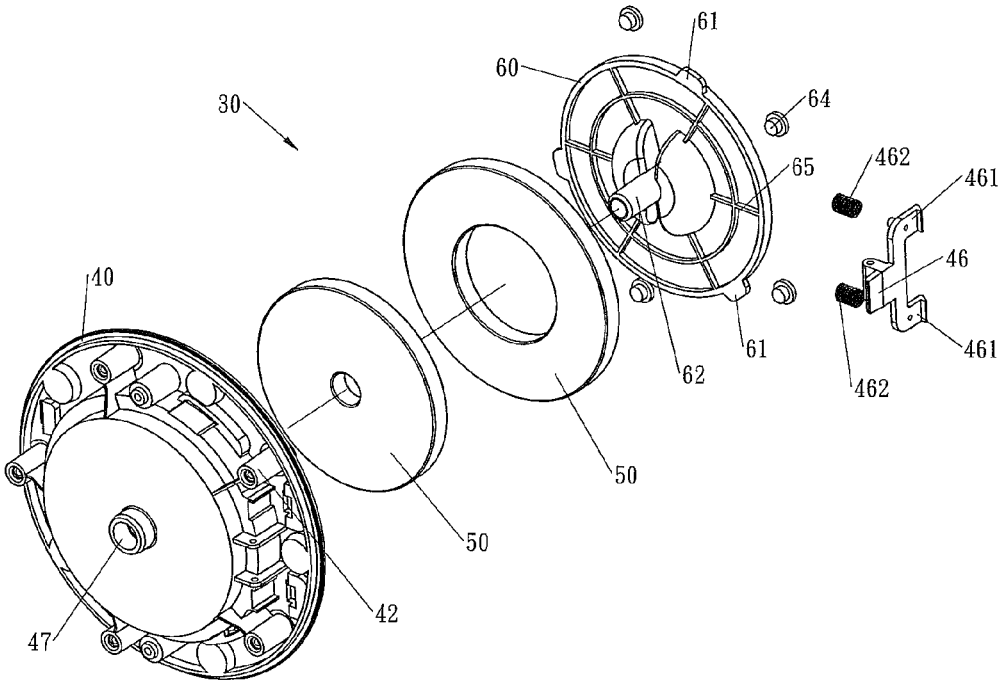
FIG. 6 is another exploded perspective view of the weight module of the exercising device as shown in FIG. 2.
Figure 7:
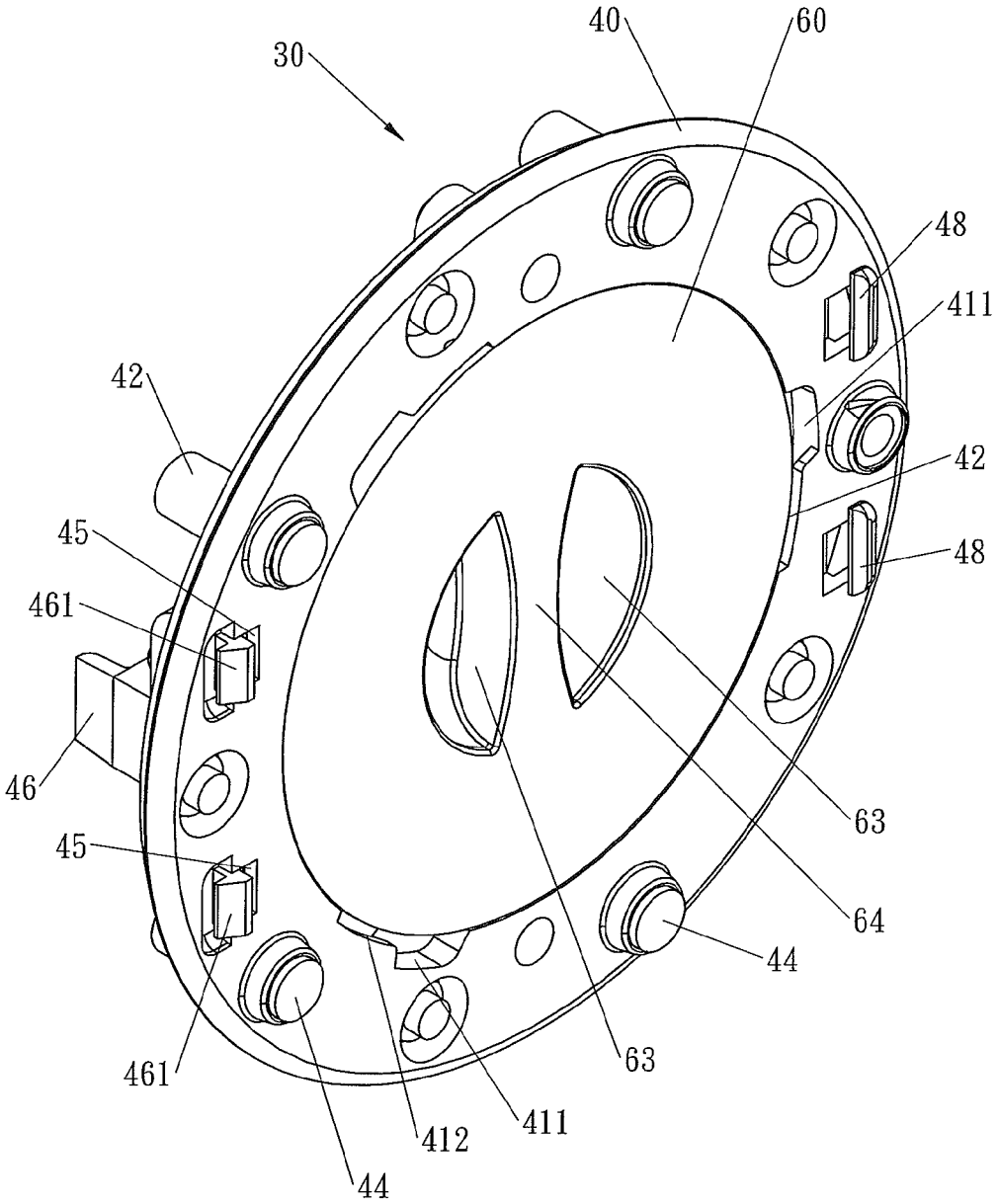
FIG. 7 is a perspective assembly view of the weight module of the exercising device as shown in FIG. 5.
Figure 8:
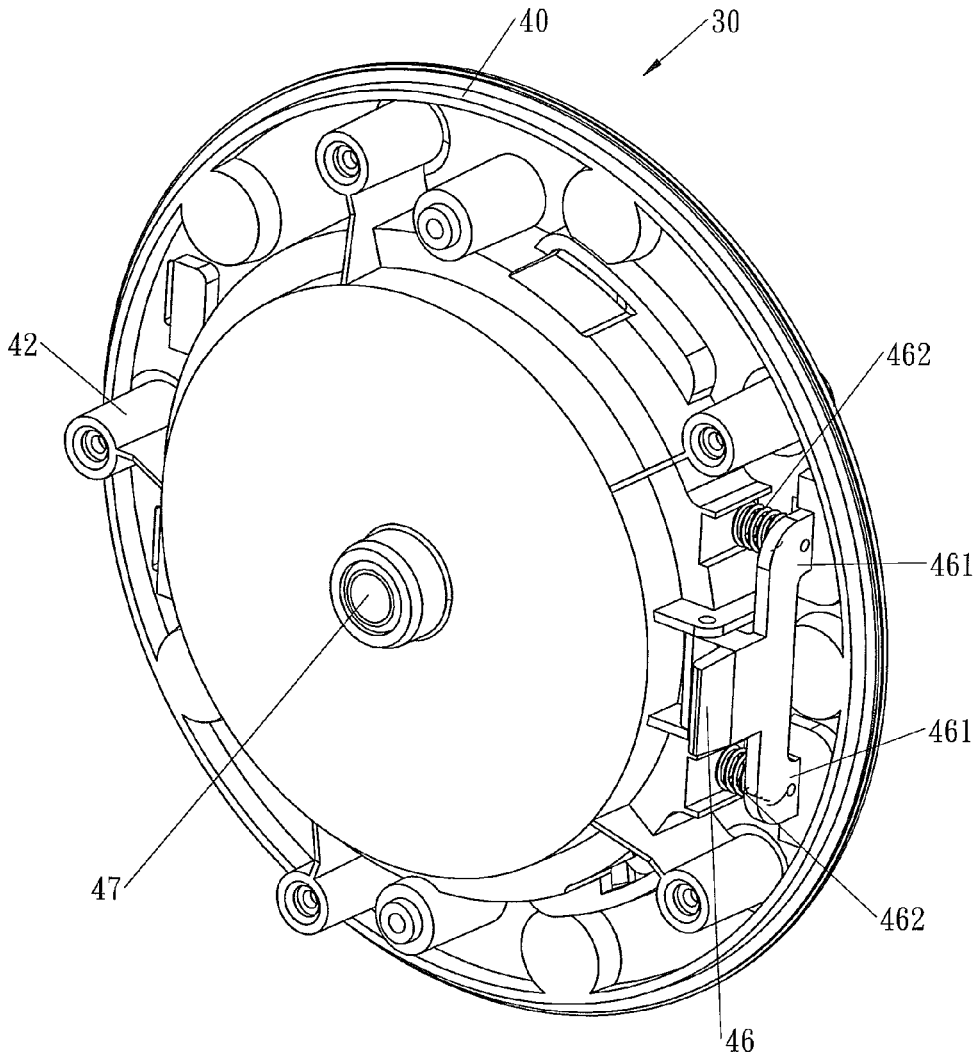
FIG. 8 is a perspective assembly view of the weight module of the exercising device as shown in FIG. 6.
Figure 9:
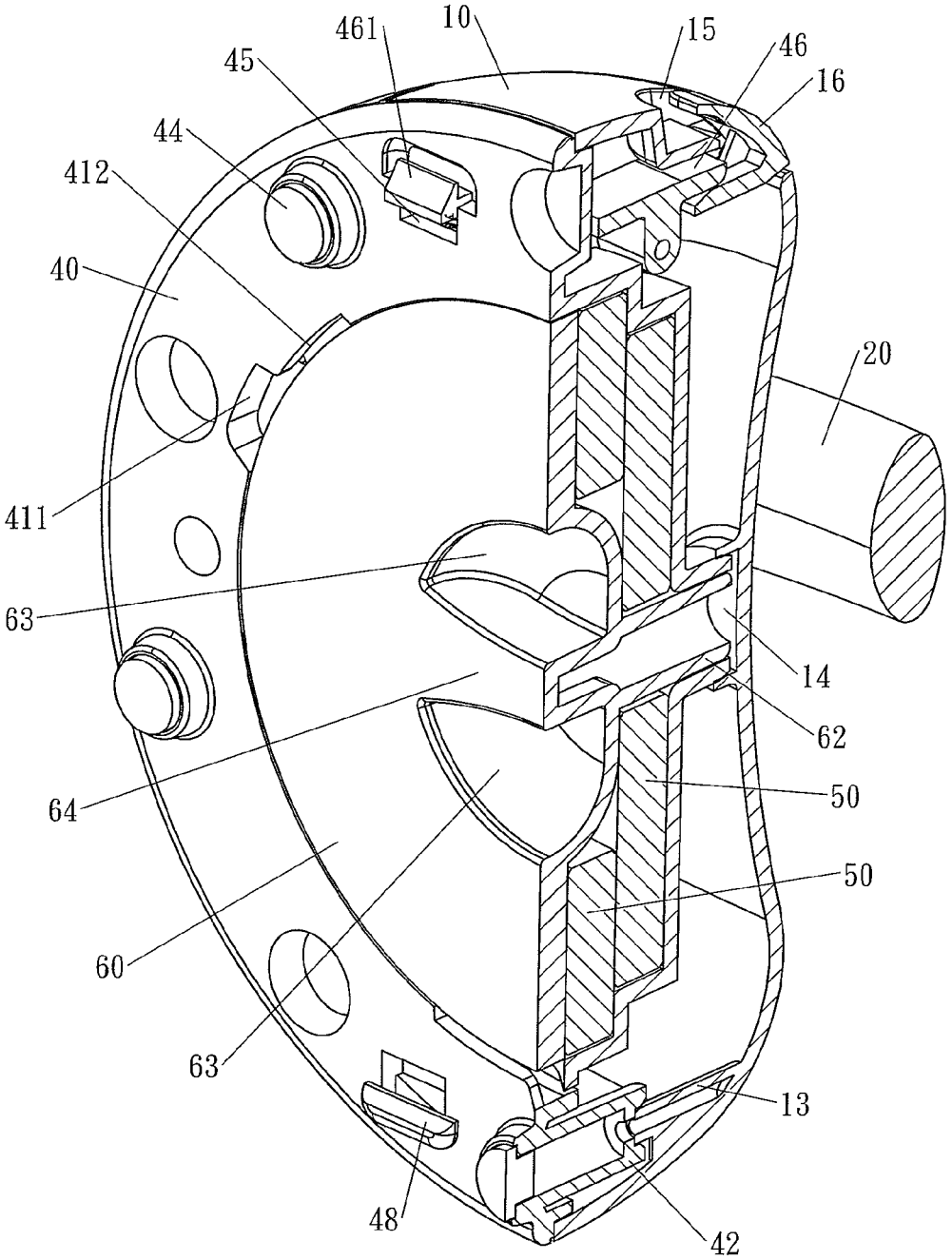
FIG. 9 is a partially perspective cross-sectional view of the exercising device as shown in FIG. 1.

Referring to the drawings and initially to FIGS. 1-12, an exercising device in accordance with the preferred embodiment of the present invention comprises two hollow shells 10 combined with each other, two grips 20 mounted on the hollow shells 10 respectively, and two weight modules 30 mounted in the hollow shells 10 respectively.

Each of the hollow shells 10 is provided with a plurality of connecting holes 11 each having a periphery provided with a plurality of elastic plates 12. Each of the hollow shells 10 is provided with a plurality of support tubes 13. Each of the hollow shells 10 has a central portion provided with a cavity 14. Each of the hollow shells 10 is provided with a mounting groove 15.

Each of the grips 20 is provided with a plurality of connecting stubs 21 extended through the connecting holes 11 of the respective hollow shell 10. Each of the connecting stubs 21 of each of the grips 20 is provided with an enlarged conical portion 22 locked onto the respective elastic plate 12 of the respective hollow shell 10, so that each of the grips 20 is locked onto the respective hollow shell 10.

Each of the weight modules 30 includes a positioning member 40 secured in the respective hollow shell 10, a covering plate 60 locked onto the positioning member 40, a plurality of weighting members 50 mounted in the positioning member 40 and located between the positioning member 40 and the covering plate 60, a swinging member 46 pivotally mounted on the positioning member 40, and a driving member 16 pivotally mounted on the respective hollow shell 10 and abutting the swinging member 46.

The positioning member 40 of each of the weight modules 30 has a disk shape and has a central portion provided with a through hole 47. The positioning member 40 of each of the weight modules 30 has a first face provided with a receiving recess 41 for mounting the weighting members 50 and a second face provided with a plurality of mounting sleeves 42 mounted on and combined with the support tubes 13 of the respective hollow shell 10 by bolts (not shown). Preferably, the receiving recess 41 of the positioning member 40 of each of the weight modules 30 has a stepped shape to receive the weighting members 50 with different sizes. The receiving recess 41 of the positioning member 40 of each of the weight modules 30 has a peripheral wall provided with at least one entrance 411, at least one limit groove 43 connected to the entrance 411, and at least one limit flange 412 connected to the limit groove 43. The positioning member 40 of each of the weight modules 30 has a periphery provided with a plurality of pads 44 surrounding the receiving recess 41. The positioning member 40 of each of the weight modules 30 is provided with two passages 45 and two recessed locking portions 48.

Figure 12:
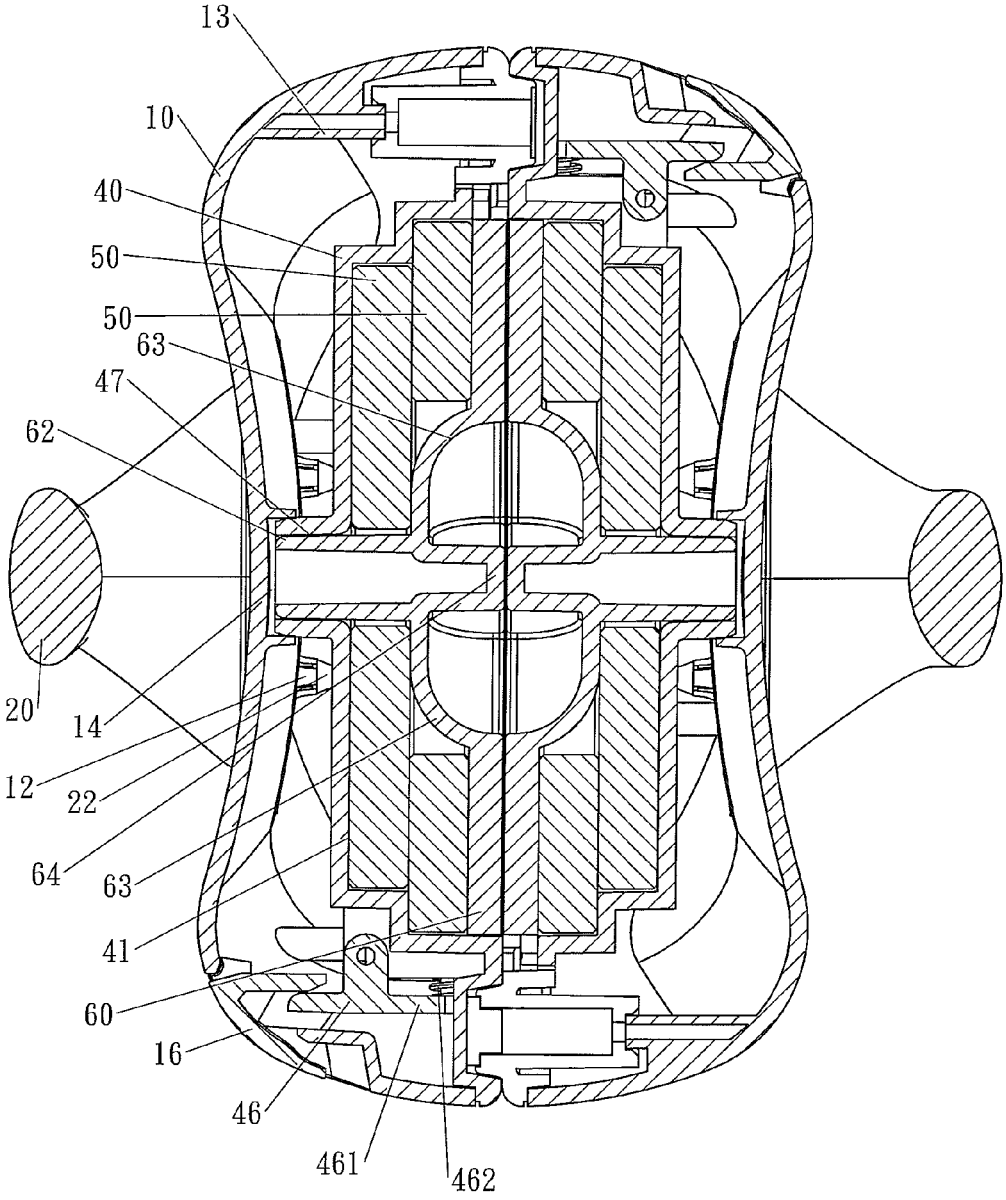
FIG. 12 is an assembly view of the exercising device as shown in FIG. 11.

The swinging member 46 of each of the weight modules 30 is provided with two locking hooks 461 extended through the passages 45 of the positioning member 40, and two springs 462 biased between the locking hooks 461 and the positioning member 40. The locking hooks 461 of the swinging member 46 of one of the weight modules 30 are detachably locked onto the locking portions 48 of the positioning member 40 of the other one of the weight modules 30, so that the weight modules 30 are combined together as shown in FIG. 12, and the hollow shells 10 are combined together as shown in FIG. 1.

Figure 10:
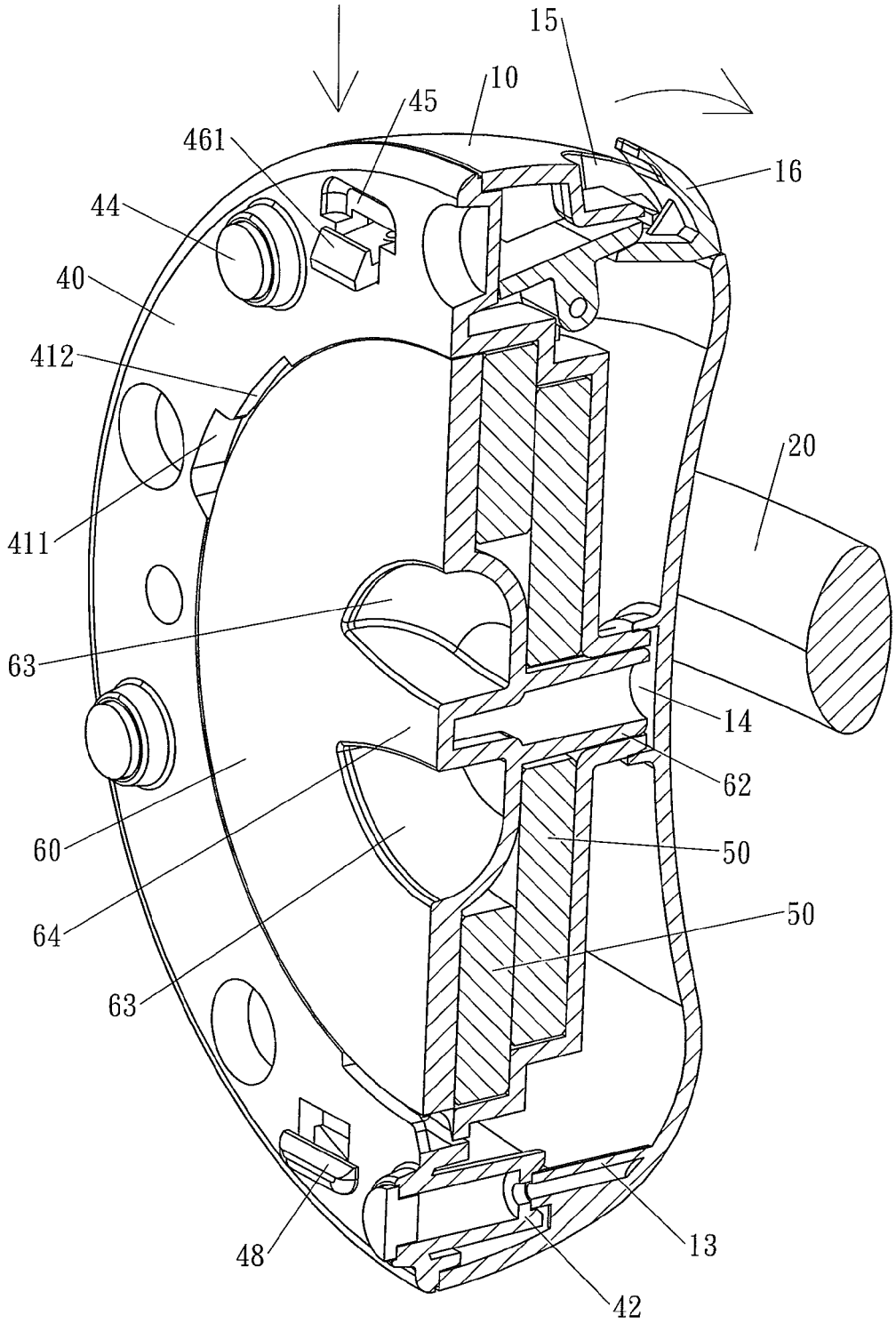
FIG. 10 is an operational view of the exercising device as shown in FIG. 9.
Figure 11:
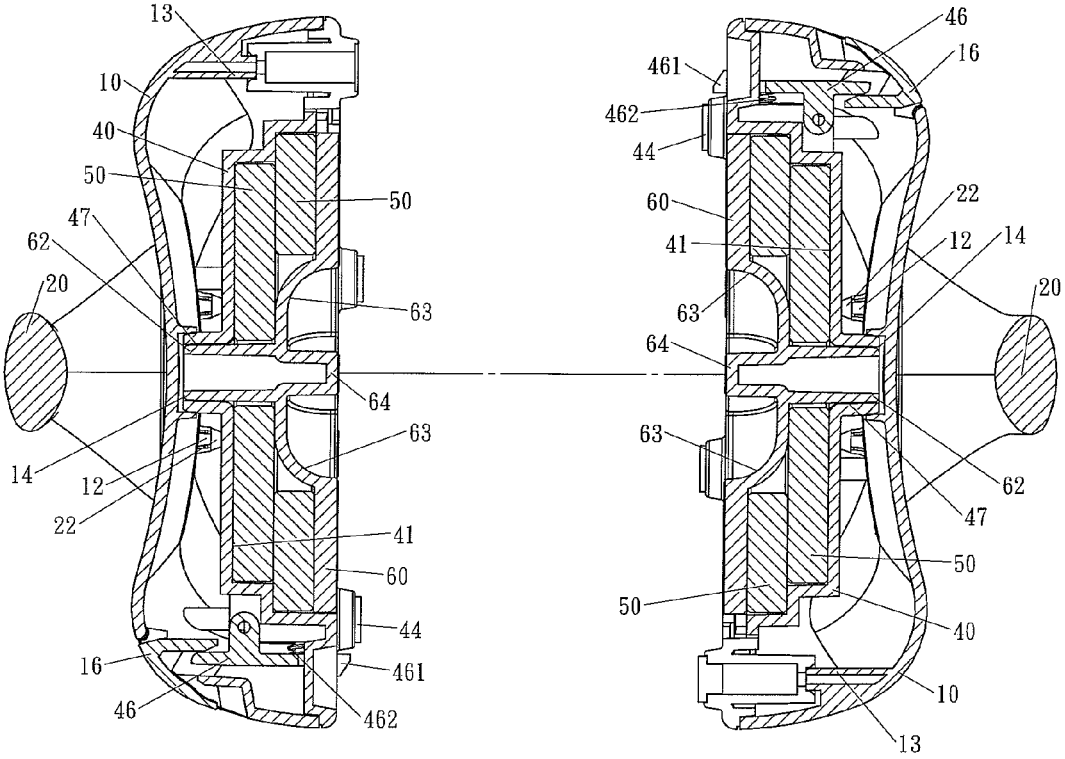
FIG. 11 is a front cross-sectional assembly view of the exercising device as shown in FIG. 2.

The driving member 16 of each of the weight modules 30 is pivotally mounted in the mounting groove 15 of the respective hollow shell 10. When the driving member 16 of each of the weight modules 30 is pivoted to press the swinging member 46 as shown in FIG. 10, the swinging member 46 of each of the weight modules 30 is pivoted, so that the locking hooks 461 of the swinging member 46 of each of the weight modules 30 are unlocked and detached from the locking portions 48 of the positioning member 40 of each of the weight modules 30. Thus, the weight modules 30 are detached from each other as shown in FIG. 11, and the hollow shells 10 are separated from each other.

The weighting members 50 of each of the weight modules 30 are mounted in the receiving recess 41 of the positioning member 40 and have different sizes. Each of the weighting members 50 of each of the weight modules 30 has a circular or annular shape. The number of the weighting members 50 can be changed to adjust the weight of each of the weight modules 30.

The covering plate 60 of each of the weight modules 30 has a circular shape and has a periphery provided with at least one locking block 61 that is inserted through the entrance 411 into the limit groove 43 of the positioning member 40 and is locked by the limit flange 412 of the positioning member 40 by rotation of the covering plate 60. The covering plate 60 of each of the weight modules 30 has a first face provided with a positioning post 62 extended through the weighting members 50 and the through hole 47 of the positioning member 40 and inserted into the cavity 14 of the respective hollow shell 10. The first face of the covering plate 60 of each of the weight modules 30 is provided with a plurality of ribs 65. The covering plate 60 of each of the weight modules 30 has a second face provided with two finger holes 63 and a baffle 64 located between the finger holes 63.

Figure 13:
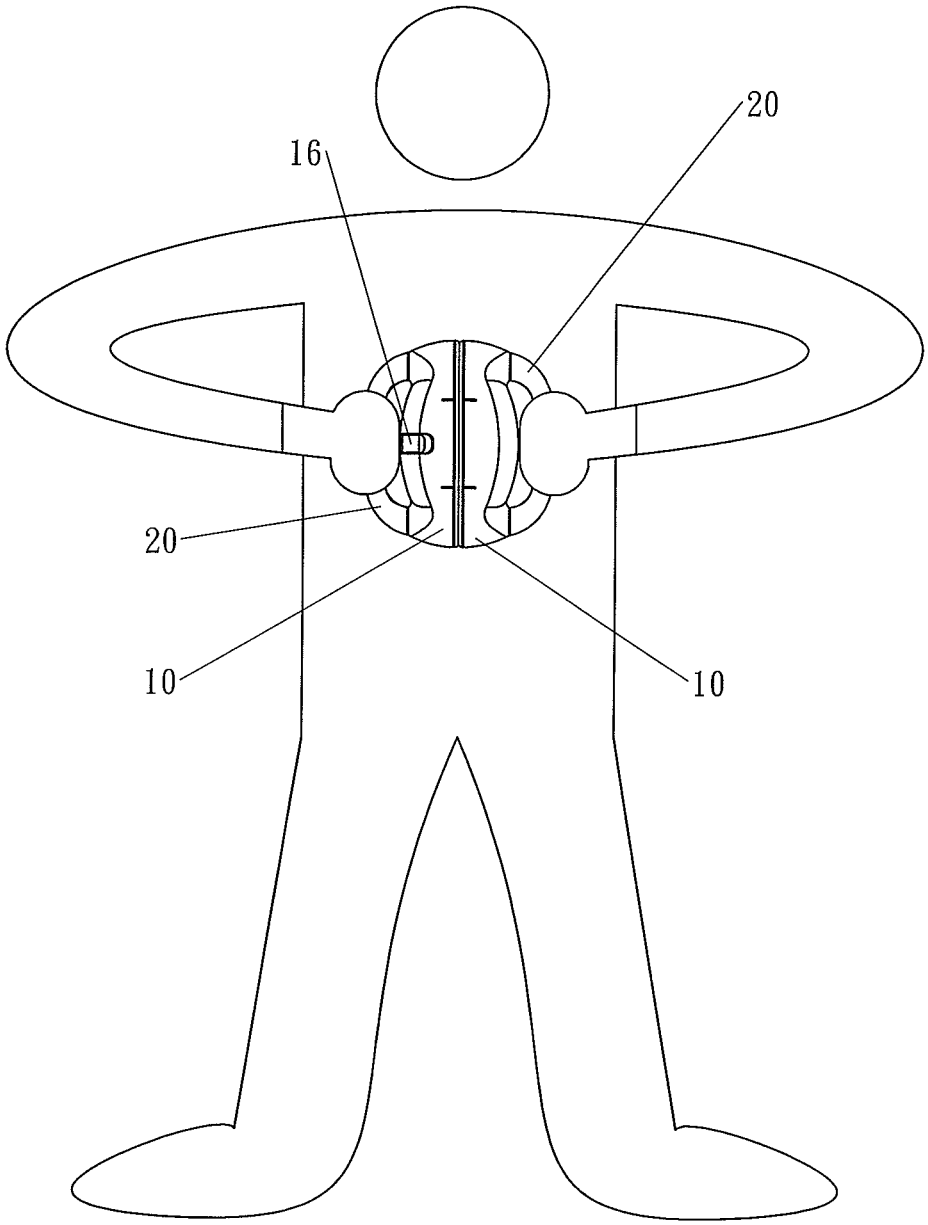
FIG. 13 is a schematic operational view of the exercising device as shown in FIG. 1 in use.

In operation, referring to FIG. 13 with reference to FIGS. 1-12, the hollow shells 10 are combined together. Thus, the user's two hands can hold the grips 20 to move the hollow shells 10 upward and downward so as to exercise the user's arms.

Figure 14:
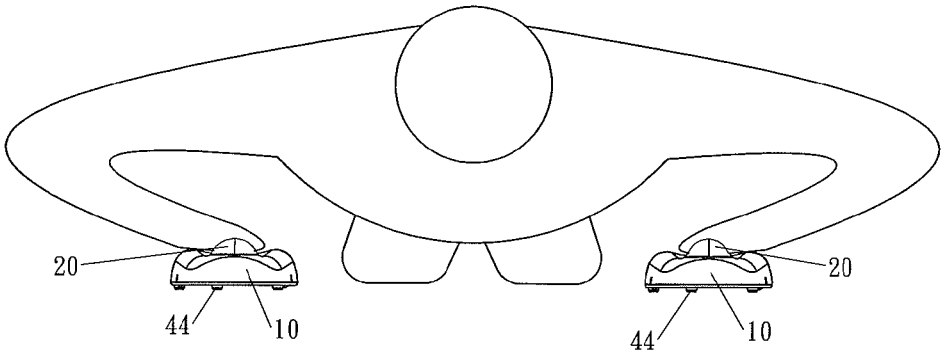
FIG. 14 is a schematic operational view of the exercising device as shown in FIG. 1 in use.

Alternatively, referring to FIG. 14 with reference to FIGS. 1-12, the hollow shells 10 are separated from each other and placed on the ground to function as a push-up aid device.

Figure 15:
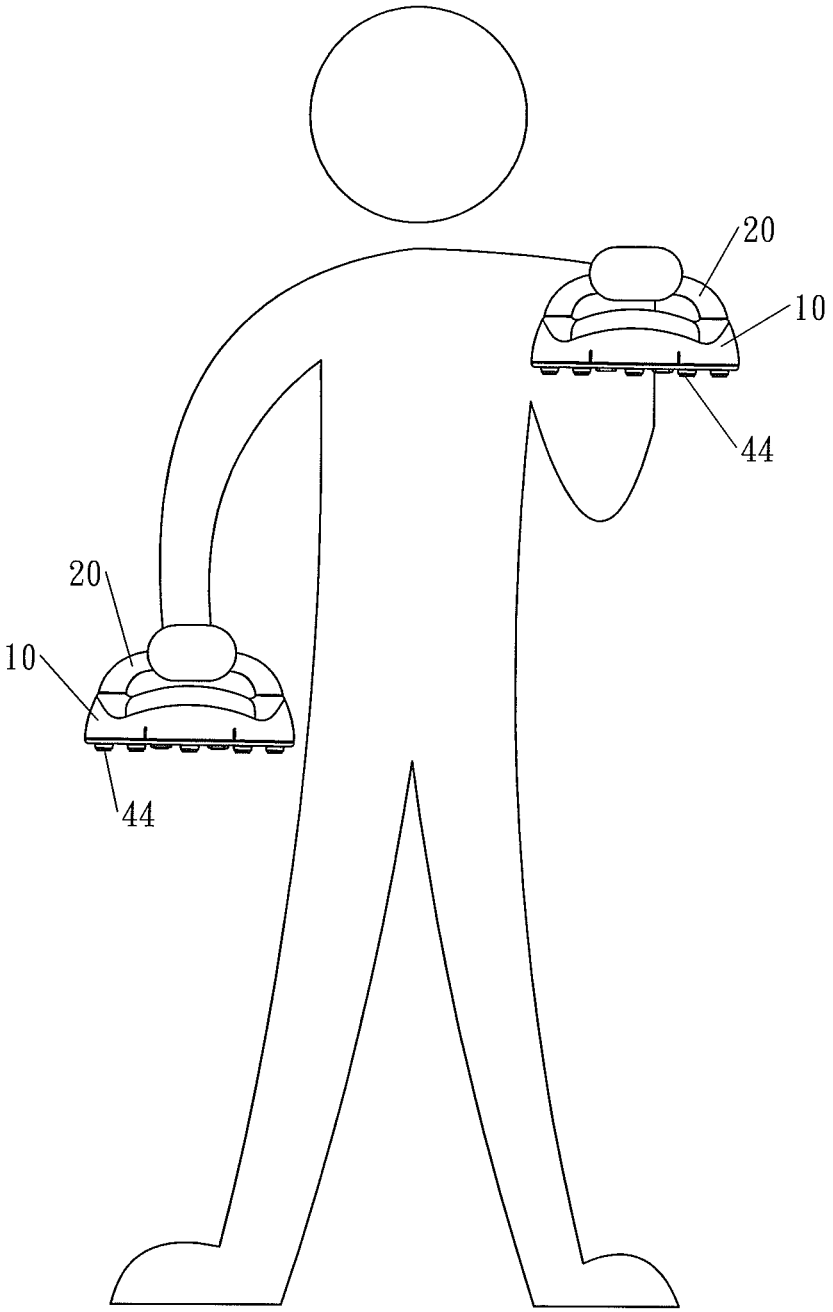
FIG. 15 is a schematic operational view of the exercising device as shown in FIG. 1 in use.

Alternatively, referring to FIG. 15 with reference to FIGS. 1-12, the hollow shells 10 are separated from each other to function as dumbbells.

Accordingly, the hollow shells 10 can be combined together and separated from each other to function as a weighting ball, a push-up aid device and dumbbells, so that the exercising device has multiple functions to perform diverse exercising and bodybuilding motions to enhance the versatility of the exercising device. In addition, the number of the weighting members 50 can be changed to adjust the weight of each of the weight modules 30 according to the user's requirement.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. An exercising device comprising: two hollow shells combined with each other; one grip mounted on each of the hollow shells; and one weight module mounted in each of the hollow shells; wherein each of the hollow shells has a central portion provided with a cavity; each of the hollow shells is provided with a plurality of support tubes; each of the weight modules includes: a positioning member secured in the respective hollow shell; a covering plate locked onto the positioning member; and a plurality of weighting members mounted in the positioning member and located between the positioning member and the covering plate; the positioning member of each of the weight modules has a central portion provided with a through hole; the positioning member of each of the weight modules has a first face provided with a receiving recess for mounting the weighting members and a second face provided with a plurality of mounting sleeves mounted on the support tubes of the respective hollow shell; the receiving recess of the positioning member of each of the weight modules has a peripheral wall provided with at least one entrance, at least one limit groove connected to the entrance, and at least one limit flange connected to the limit groove; the covering plate of each of the weight modules has a periphery provided with at least one locking block that is inserted through the entrance into the limit groove of the positioning member and is locked by the limit flange of the positioning member by rotation of the covering plate; the covering plate of each of the weight modules has a first face provided with a positioning post extended through the weighting members and the through hole of the positioning member and inserted into the cavity of the respective hollow shell; and the weighting members of each of the weight modules are mounted in the receiving recess of the positioning member.

2. The exercising device of claim 1, wherein:

each of the hollow shells is provided with a plurality of connecting holes each having a periphery provided with a plurality of elastic plates;

each of the grips is provided with a plurality of connecting stubs extended through the connecting holes of the respective hollow shell; and each of the connecting stubs of each of the grips is provided with an enlarged conical portion locked onto the respective elastic plate of the respective hollow shell.

3. The exercising device of claim 1, wherein the positioning member of each of the weight modules has a periphery provided with a plurality of pads surrounding the receiving recess.

4. The exercising device of claim 1, wherein the mounting sleeves of the positioning member of each of the weight modules are combined with the support tubes of the respective hollow shell by bolts.

5. The exercising device of claim 1, wherein the weighting members of each of the weight modules have different sizes.

6. The exercising device of claim 1, wherein the receiving recess of the positioning member of each of the weight modules has a stepped shape to receive the weighting members with different sizes.

7. The exercising device of claim 1, wherein the covering plate of each of the weight modules has a second face provided with two finger holes and a baffle located between the finger holes.

8. The exercising device of claim 1, wherein the first face of the covering plate of each of the weight modules is provided with a plurality of ribs.

9. The exercising device of claim 1, wherein: each of the hollow shells is provided with a mounting groove; each of the weight modules further includes: a swinging member pivotally mounted on the positioning member; and a driving member pivotally mounted on the respective hollow shell and abutting the swinging member; the positioning member of each of the weight modules is provided with two passages and two recessed locking portions; the swinging member of each of the weight modules is provided with two locking hooks and two springs, wherein one locking hook of the two locking hooks extends through one passage of the two passages of the positioning member, and the other locking hook of the two locking hooks extends through the other passage of the two passages of the positioning member, and wherein one spring of the two springs is biased between the positioning member and one locking hook of the two locking hooks, and the other spring of the two springs is biased between the positioning member and the other locking hook of the two locking hooks; the locking hooks of the swinging member of one of the weight modules are detachably locked onto the locking portions of the positioning member of the other one of the weight modules; and the driving member of each of the weight modules is pivotally mounted in the mounting groove of the respective hollow shell.

* * * * *